United States Patent [19]

Combet et al.

[11] Patent Number: 4,949,114

[45] Date of Patent: Aug. 14, 1990

[54] DEVICE FOR INTRODUCING THE FREE END OF A PHOTOGRAPHIC FILM TO BE DEVELOPED, UNWOUND FROM A REEL, INTO A FILM DEVELOPING UNIT

[75] Inventors: Philippe Combet, Sassenage; Serge Crasnianski, Meylan, both of France

[73] Assignee: Kis Photo Industrie/Serge Crasnianski, France

[21] Appl. No.: 371,637

[22] Filed: Jun. 26, 1989

[30] Foreign Application Priority Data

Jun. 30, 1988 [FR] France ..... 88 09111

[51] Int. Cl.[5] ..... G03D 3/13

[52] U.S. Cl. ..... 354/313; 354/319; 354/321

[58] Field of Search ..... 354/310, 312, 313, 314, 354/319, 320, 321, 322; 355/27, 28

[56] References Cited

U.S. PATENT DOCUMENTS

| | | | |
|---|---|---|---|
| 2,484,378 | 10/1949 | Freeman | 354/310 |
| 2,692,541 | 10/1954 | Lesjak | 354/310 |
| 3,568,587 | 3/1971 | Laval | 354/310 |
| 3,815,457 | 6/1974 | Shimmin | 354/354 X |
| 4,200,383 | 4/1980 | Bendoni et al. | 354/314 |
| 4,531,819 | 7/1985 | Katsuyama | 355/28 X |

FOREIGN PATENT DOCUMENTS 775175 12/1934 France .

*Primary Examiner*—A. A. Mathews

*Attorney, Agent, or Firm*—Wall & Roehrig

[57] ABSTRACT

A device for introducing the free end of a negative film unwound from a reel into a developing unit. The device is constituted by a clamp formed by a lower shell and an upper shell articulated about an axis parallel to the spindle of the reel. The clamp includes a cylindrical cradle adapted to receive the reel and prevent rotation of the reel during unwinding of the film. A rectilinear portion of the clamp is contiguous with the cradle and is adapted to guide the film during unwinding. The rectilinear portion includes two parallel paths for guiding the film. The rectilinear portion includes a first window for passage of a blade of a cutting member for cutting the film when the unwinding of the film is complete. The rectilinear portion includes a second window for passage of a pair of press rollers for advancing the film.

10 Claims, 2 Drawing Sheets

DEVICE FOR INTRODUCING THE FREE END OF A PHOTOGRAPHIC FILM TO BE DEVELOPED, UNWOUND FROM A REEL, INTO A FILM DEVELOPING UNIT

FIELD OF THE INVENTION

The present invention relates to a device for introducing the free end of a negative film to be developed, unwound from a reel, into a unit for developing photographic films; it also relates to a module for introducing this device into the film-developing unit making it possible thereafter automatically to cut the other end of this film when the latter has been unwound from its reel and remains fixed thereto; finally, it relates to machines for developing negative films equipped in this way.

BACKGROUND OF THE INVENTION

In present-day film developers, the cutting device essentially comprises electro-magnets fast with the cutters, associated with cells detecting the presence of the film. Although this arrangement generally gives satisfaction from the technical standpoint, it nonetheless remains expensive and sensitive to outside influences. This solution cannot suit inexpensive automatic machines manipuated by inexperienced staff.

French Patent Application No. 87 14228 of Oct. 9, 1987 proposes a satisfactory solution from the mechanical standpoint, but in which positioning of the film is still too delicate for an inexperienced operator.

It is an object of the present invention to overcome these drawbacks.

It envisages a device of the type in question which ensures easy positioning of the reel of film to be developed, without employing a leader, which ensures good tightness of the assembly with respect to light and an automatic cut of the film at the end of unwinding. This device further enables an even inexperienced operator to prepare such positioning in advance outside the machine, which is translated by an appreciable saving.

SUMMARY OF THE INVENTION

This device for introducing the free end of a negative film to be developed into a film developing unit, unwound from a reel, in which the film to be developed:

- is unwound about the axis of the reel which rests in a cradle-shaped support;
- is firstly advanced by a first pair of motorized press rollers, then by a plurality of successive pairs of rollers disposed in the film developing unit proper;
- and in which the other end of the unwound film, still fixed to the unwind spindle of the reel, is cut by an appropriate cutting member; is characterized in that it is constituted by a clamp formed by two shells, respectively lower and upper, articulated about an axis parallel to the unwind spindle of the reel, said clamp comprising:
- a cylindrical cradle proper, adapted to receive the reel to be unwound and to prevent rotation thereof during unwinding of the film;
- a rectilinear portion, contiguous with the cradle, adapted to guide the film during unwinding thereof, comprising:
  - two parallel paths for guiding the film,
  - a first window for passage of the blade of the cutting member, when unwinding of the film is complete,

- a second window for passage of the first pair of press rollers for advancing the film.

Advantageously, in practice:

- the portion of connection of the lower shell with the rectilinear portion for guiding the film presents at each of the ends of the two parallel guiding paths, a stop against which the lower lip of the zone of issue of the film of the reel abuts;
- the first window for passage of the cutting lip is constituted by an opening made in the lower shell and by another opening made opposite, in the upper shell;
- the lower face of the lower shell presents a housing adapted to receive the end of the trigger actuating the cutting blade;
- the lower shell of the clamp presents on its outer faces at each of the ends of the guiding paths, studs for positioning the clamp in the module for introduction, adapted to allow a displacement of said clamp at the end of unwinding;
- the free ends of the rectilinear portions of the two shells present clipping means.

The invention also relates to a module for introducing this device, loaded with a reel of film, into a film developing unit. This module is characterized in that it comprises:

- a light-proof box closed by an articulated lid, adapted to receive and position said clamp,
- the first pair of rollers for advancing the film, disconnectable and adapted to be positioned in the second window of the clamp after closure of the lid, comprises a drive roller disposed in the fixed part of the box, whilst the counter-press roller is fixed on the inner face of the lid,
- guillotine shears of which the blade is adapted to cut the film at the end of unwinding by engaging in the first window of the clamp.

Advantageously, in practice:

- the module for introduction also comprises a second pair of rollers driven in synchronism by the same gear motor as the first pair, to draw the unwound film in the guiding paths for introducing the film in the developing unit;
- the driven shaft of this gear motor comprises a free wheel which, on the one hand, meshes with the drive pinions of the two pairs of rollers and which, on the other hand, is disconnectable when the free end of the film unwound from the reel is taken over by the first pair of rollers of the film developing unit;
- end of the path guiding the unwound film disposed just upstream of the first pair of rollers advancing the film in the film developing tank comprises a detection cell for determining the moment when the free end of the unwound film is taken over by the first pair of rollers of the film developing unit, in order to stop rotation of the gear motor;
- the cutting member is constituted by guillotina shears comprising a cutting blade proper fixed to a blade-holder, itself in abutment against a trigger moved, at the end of unwinding, by a lateral translation of the clamp; the free end of the articulated trigger is engaged in a housing arranged to that end under the rectilinear portion of the lower shell;

finally, the assembly also comprises:

- a first safety means preventing the lid from opening when the film is being unwound;

a second safety means blocking displacement of the blade-holder when the lid is open.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
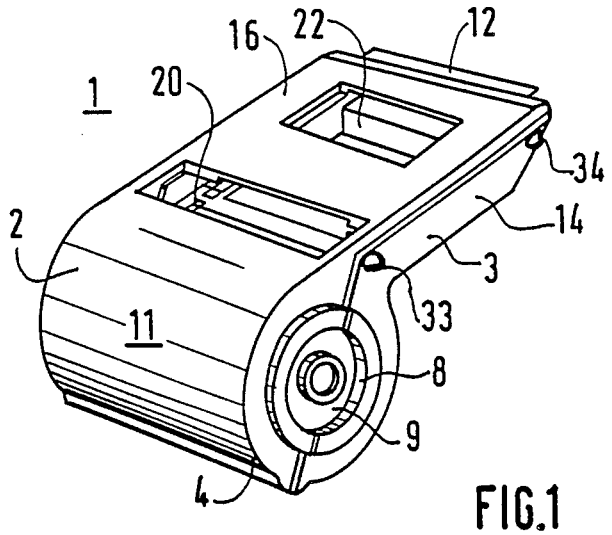
FIG. 1 is a summary perspective view of a clamp according to the invention shown in closed position.
Figure 2:
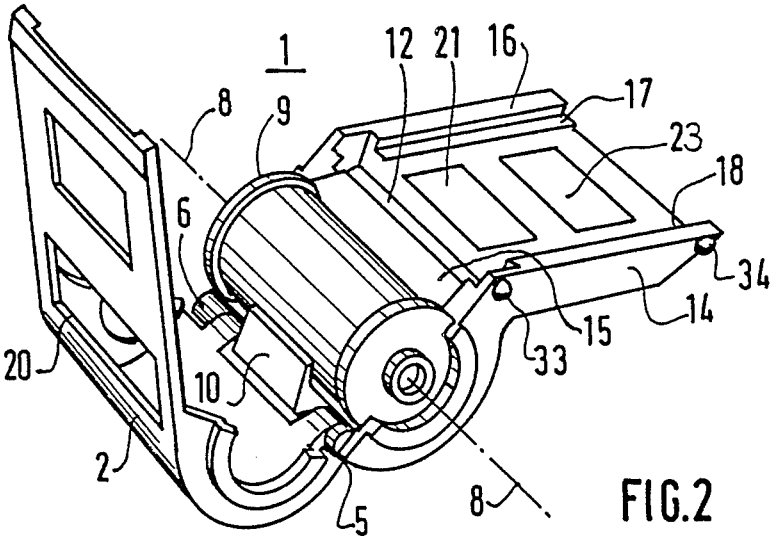
FIG. 2 is a likewise perspective view of this same clamp, but in open position, with the reel in position but film not engaged.

Referring now to the drawings, the clamp according to the invention, generally designated by reference 1, comprises two moulded shells, upper 2 and lower 3 respectively, articulated about an axis 4 by hinges 5 and 6, said axis being parallel to the unwind axis 8 of the reel 9 once in position.

The lower shell 3 presents, in the vicinity of axis 4, a stop 10 adapted to block the reel 9 once in position.

The two shells 2, 3 define a cylindrical cradle generally designated by reference 1 , adapted to receive the reel of film. In order to prevent rotation of this reel 9 during unwinding of the film, generally designated by reference 12, the portion of connection of the lower shell 3 with the rectilinear portion 14 for guiding the film presents a stop 13 against which abuts the lower lip 15 of the zone of issue of the film 12 from the reel 9. The two shells 2, 3 then extend in two rectilinear portions 14, 16 respectively, contiguous to the cradle, adapted to guide the film 12 during unwinding. These two rectilinear portions 14, 16 are clipped at their end in order to hold the film 12 during unwinding. These portions 14, 16 firstly comprise two parallel guide paths 17, 18 respectively on which slide the unwound film and more precisely the perforations for advance.

According to a feature of the invention, the two rectilinear portions 14, 16 present two opposite openings 20 and 21 respectively, forming a first window for the passage of the blade 30 of the cutting member when unwinding of the film 12 approaches completion. In an advantageous embodiment, this window is constituted by a first opening 21 made in the rectilinear portion 14 of the lower shell 3, whilst the portion 16 of the upper shell 2 presents a window 20 disposed opposite opening 21. In an economical variant, the window 20 may be replaced by a hollow housing. The rectilinear portions 14, 16 then present two other opposite openings 22, 23 respectively for the passage of the first pair of press rollers 24, 25 for advancing the film 12.

The lower face of the rectilinear portion 14 of the lower shell 3 presents a housing 26 adapted to receive the end 31 of the trigger 32 for actuating the support of the cutting blade 30.

It will be readily understood that the film can be positioned in the clamp 1 by inexperienced staff outside the film developing unit. To that end, the operator opens the two shells 2, 3, engages the reel 9, blocking it on the stop 10 and the lip 15 against the stop 13. By hand, he/she pulls the free end of the film 12 to guide the edges of the film on the guide paths 17, 18 until the end of the film 12 projects slightly.

Figure 3:
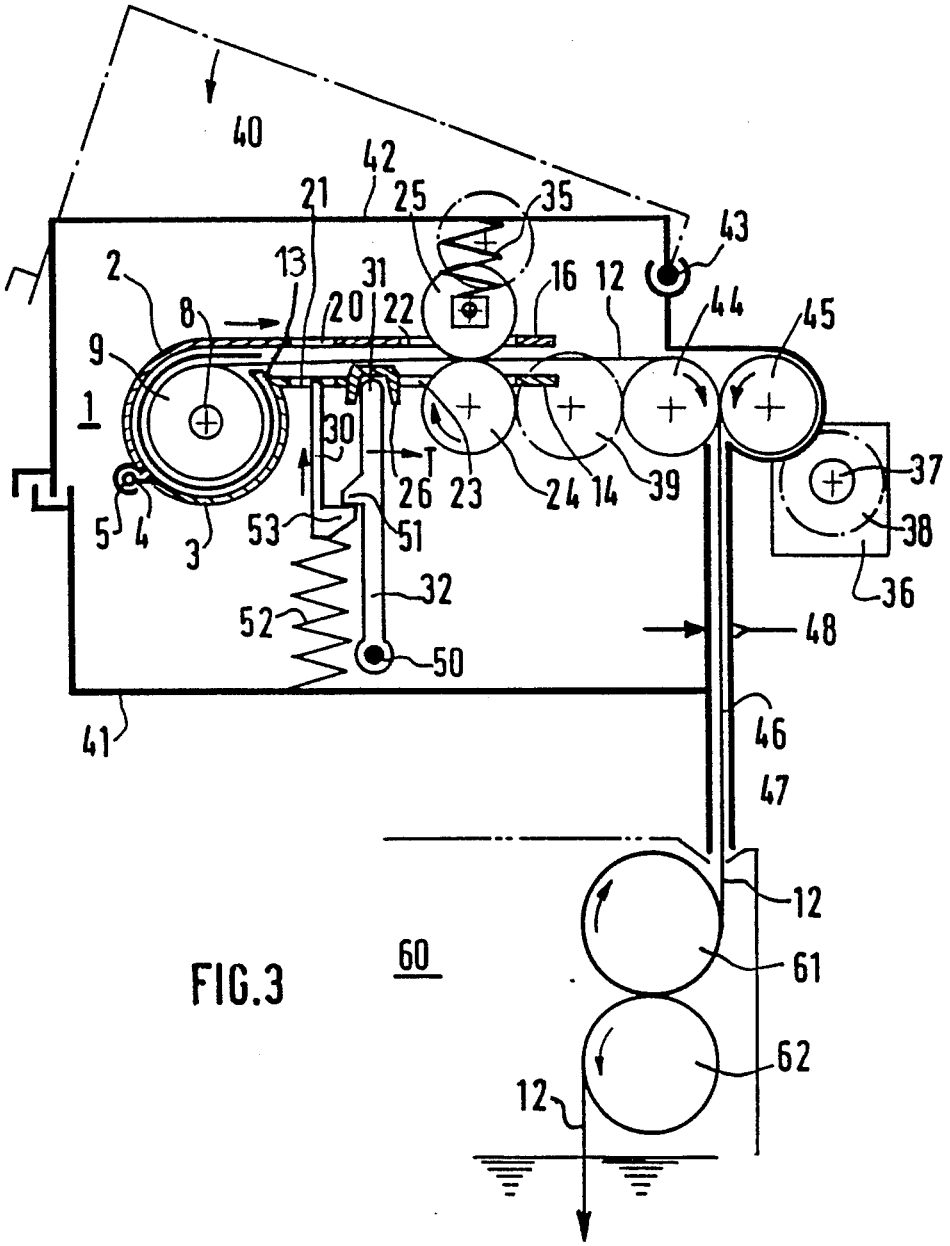
FIG. 3 is a view in section of the introducing module according to the invention.

He/she then introduces the clamp 1 into the introducing module generally designated by reference 40, shown in FIG. 3, of the film developing unit generally designated by reference 60.

This module 40 comprises a light-proof box 41 closed by a lid 42 articulated at 43. Thanks to stops or positioning studs 33 and 34 respectively provided to that end at the end of the guide paths 17, 18, the clamp is positioned in the fixed part 41 of the introducing module 40. The counter press roller 25 associated with a spring 35 is fixed to the lid 42.

The driven shaft 37 of a gear-down motor 36 comprises a free wheel 38 which meshes by pinions 39 on the one hand with the drive roller 24 of the first pair of rollers, but also with two other driving guide rollers 44, 45 driven in synchronism with 24, 25 to draw the unwound film 12 in the paths 46 for guiding the film up to the developing unit 60. In the vicinity of the end 47 of this path 46, is disposed a detection cell 48 which determines the moment when the free end of the unwound film 12 is taken over by the first pair of rollers 61, 62 of the film developing unit 60. Drive of the gear motor 36 and, consequently, of rollers 24, 44, 45, is then stopped.

The cutting member comprises a trigger 32 articulated at 50 of which end 31 is, as already stated, engaged in the housing 26 provided to that end. This trigger 32 cooperates by a stop 51 with a blade-holder 30 associated with a spring 52 and presenting a counter-stop 53. The end of the blade-holder 30 comprises the cutting blade proper forming guillotine 30.

Positioning being effected, i.e. the loaded clamp as shown in FIG. 1 being placed in position in the introducing module, the operator closes the lid 42. The counter press roller 25 automatically grips the end 12 of the film to be unwound. Safety means (not shown) prevent the lid 42 from opening when the film 12 is being unwound and other safety means block displacement of the blade-holder 30 when the lid 42 is open.

Locking of the lid 42 automatically switches on motor 36. The first pair of rollers 24, 25 advances the film up to the second pair of rollers 44, 45, said film being engaged in the path 46. When it arrives on pair 61, 62, the detector 48 controls stop of the motor 36 and the film is taken over and advanced by the developing unit 60. At the end of unwinding, as the other end of the film 12 is attached to the unwind spindle 8, a longitudinal traction, indicated by arrow T, follows. This provokes a displacement of the clamp towards the right and consequently, a pivoting of the trigger 32 which then releases the cutter 30 which thus cuts the end of the unwound film.

An appropriate device cocks the cutter 30 when the lid 42 is opened.

The device according to the invention is particularly simple, easy to construct and may be employed by non-specialized staff. In addition, it allows reels or films to be loaded in the clamp outside the machine itself, which is translated by an appreciable saving of time.

Consequently, this arrangement may advantageously be used in automatic film developing machines, as well as in combined film developing and photograph printing machines.

What is claimed is:

1. A device for introducing a free end of a photographic film into a film developing unit, after the film is unwound from a film reel having an unwind spindle, in which unit the film is to be developed, the film developing unit comprising a generally cylindrical cradle-shaped support for supporting the reel so that the film can be withdrawn from it about an axis of the reel unwind spindle;

means for advancing the film including a first pair of motorized press rollers and a plurality of successive pairs of rollers disposed along a film path of the film developing unit; and means for severing the other end of the film, which remains affixed to the unwind spindle of the reel, including a cutting member having a blade;

said film free-end introducing device comprising a clamp formed of upper and lower wheel portions articulated about a pin parallel to the unwind spindle of the reel said clamp including said cradle-shaped support of the film developing unit shaped so as to receive said reel and including means to prevent rotation of the reel during unwinding of the film therefrom, and a rectilinear portion contiguous with said cylindrical cradle portion of the film developing unit and adapted to guide the film during unwinding from the reel, the rectilinear portion including:

a pair of parallel film guide channels for guiding the film, a first window for passage therethrough of a blade of a cutting member when the unwinding of the film is complete, and a second window for passage of said first pair of press rollers against said film for contacting and advancing the film.

2. The device of claim 1 wherein the lower shell portion at a junction therein of said cylindrical cradle with the rectilinear portions for guiding the film presents, at each of the ends of the two parallel guide channels, a stop against which abuts a lower lip of a protruding outlet of the reel for issue of the film from the reel.

3. The device of claim 1, wherein the first window for passage of a cutting lip of the cutting member is constituted by an opening made in the lower shell and by another opening opposite to it in the upper shell.

4. The device of claim 1, wherein a lower surface of the lower shell portion includes a socket adapted to receive a trigger actuating the cutting blade.

5. The device of claim 1 wherein:

the part of the lower shell portion that comprises the cylindrical cradle to receive the reel includes, in the vicinity of said pin, and, serving as said means to prevent rotation of the reel during unwinding, a stop adapted to block said reel from rotation during unwinding, said rectilinear portion comprising, in order, from said cylindrical cradle portion, said first window for the passage of the blade, a housing receptacle directed downwardly, and said second window for the passage of a pair of rollers;

and the upper shell portion, articulated about said pin, comprises a second rectilinear portion parallel to the first-mentioned rectilinear portion, and adapted to clip thereon, comprising a recessed housing opposite the first window and a window disposed opposite the second window.

6. A module for introducing the clamp of claim 1, loaded with a reel of film, into the film developing unit, wherein said module comprises:

a light-proof box closed by an articulated lid, adapted to receive and position said clamp, said first pair of rollers for advancing the film, disconnectable and adapted to be positioned in the second window of the clamp after closure of the lid, comprising a drive roller disposed in the fixed part of the box, and an associated counter-press roller fixed on an inner surface of the lid;

a second pair of driving rollers driven in synchronism by a common gear drive with the first pair, to draw the unwound film along the guide channels for introducing the film into the developing unit;

and, serving as said means for severing the other end of the film, guillotine shears having a blade adapted to cut the film at the end of unwinding by engaging the film through the first window of the clamp.

7. The introducing module of claim 6, wherein a driven shaft of said gear drive comprises a free wheel which, on the one hand, meshes with drive pinions for the two pairs of rollers and which, on the other hand, is disconnectable when the withdrawal of the free end of the film being unwound from the reel is taken over by rollers of the film developing unit with which the film introducing module is associated.

8. The introducing module of claim 7, wherein at the end of the guide channels disposed just upstream of the point of introduction in the film developing unit, a detection cell is situated for sensing when the free end of the unwound film is taken over by a first pair of rollers of said unit, in order to stop the gear drive.

9. The introducing module of claim 6, wherein the cutting member is constituted by guillotine shears comprising a cutting blade proper fixed to a blade-holder, the latter against a trigger moved at the end of unwinding by a lateral translation of the clamp, the articulated trigger having a free end being engaged in a housing receptacle arranged in an underside of the rectilinear portion of the lower shell.

10. The introducing module of claim 9 further comprising:

a first safety means preventing the lid from opening when the film is being unwound; and a second safety means blocking displacement of the blade-holder when the lid is open.

* * * * *